US011314187B2

(12) United States Patent
Kikuchi

(10) Patent No.: US 11,314,187 B2
(45) Date of Patent: Apr. 26, 2022

(54) HEAT REFLECTION USING REFLECTOR IN FIXING DEVICE AND IMAGE FORMING APPARATUS

(71) Applicant: TOSHIBA TEC KABUSHIKI KAISHA, Tokyo (JP)

(72) Inventor: Kazuhiko Kikuchi, Yokohama Kanagawa (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/210,877

(22) Filed: Mar. 24, 2021

(65) Prior Publication Data

US 2021/0208527 A1 Jul. 8, 2021

Related U.S. Application Data

(63) Continuation of application No. 16/901,408, filed on Jun. 15, 2020, now Pat. No. 10,983,462, which is a (Continued)

(30) Foreign Application Priority Data

Jan. 11, 2018 (JP) ..... JP2018-002878

(51) Int. Cl.
*G03G 15/20* (2006.01)

(52) U.S. Cl.
CPC ..... *G03G 15/2039* (2013.01); *G03G 15/2007* (2013.01); *G03G 15/2028* (2013.01); *G03G 15/2053* (2013.01)

(58) Field of Classification Search
CPC ..... G03G 15/2039; G03G 15/2028; G03G 15/2053; G03G 15/2007; G03G 15/2017; G03G 15/5045
See application file for complete search history.

(56) References Cited

U.S. PATENT DOCUMENTS 5,528,351 A 6/1996 Tsuji
9,229,392 B2 1/2016 Nakano
(Continued)

FOREIGN PATENT DOCUMENTS

JP H08-115003 A 5/1996
JP 2013-178511 A 9/2013
(Continued)

OTHER PUBLICATIONS

Japanese Notice of Reasons for Refusal dated Jul. 27, 2021, in corresponding Japanese Patent Application No. 2018-002878, 6 pages (with Translation).

*Primary Examiner* — Susan S Lee
(74) *Attorney, Agent, or Firm* — Kim & Stewart LLP

(57) ABSTRACT

A fixing device includes a belt, a roller, a heater, a reflector board, a stay, and a thermally-conductive member. The belt is rotatable in a rotational direction. The roller is positioned to be in contact with an outer surface of the belt so as to form a nip between the roller and the belt. The heater is configured to heat an inner surface of the belt. The reflector board is configured to reflect heat generated by the heater toward the inner surface of the belt. The stay is in contact with the reflector board. The thermally-conducive member is thermally connected between the belt and at least one of the reflector board and the stay. The thermally-conducive member includes a first portion that is in contact with the belt at a first region downstream with respect to the nip in the rotational direction.

20 Claims, 3 Drawing Sheets

Related U.S. Application Data continuation of application No. 16/574,615, filed on Sep. 18, 2019, now Pat. No. 10,705,460, which is a continuation of application No. 16/111,399, filed on Aug. 24, 2018, now Pat. No. 10,459,380.

(56) References Cited

U.S. PATENT DOCUMENTS

| | | | | |
|---|---|---|---|---|
| 9,523,949 | B1 | 12/2016 | Kikuchi | |
| 10,459,380 | B2 | 10/2019 | Kikuchi | |
| 2008/0292372 | A1* | 11/2008 | Han | G03G 15/2039 399/328 |
| 2013/0251390 | A1 | 9/2013 | Ishii et al. | |
| 2015/0063882 | A1 | 3/2015 | Nakano | |
| 2015/0063883 | A1 | 3/2015 | Nakano | |

FOREIGN PATENT DOCUMENTS

| | | | |
|---|---|---|---|
| JP | 2015-045712 | A | 3/2015 |
| JP | 2016-080831 | A | 5/2016 |

* cited by examiner

HEAT REFLECTION USING REFLECTOR IN FIXING DEVICE AND IMAGE FORMING APPARATUS

CROSS-REFERENCE TO RELATED APPLICATIONS

This application is a continuation of U.S. patent application Ser. No. 16/901,408, filed on Jun. 15, 2020, which is a continuation of U.S. patent application Ser. No. 16/574,615, filed on Sep. 18, 2019, now U.S. Pat. No. 10,705,460, issued on Jul. 7, 2020, which is a continuation of U.S. patent application Ser. No. 16/111,399, filed on Aug. 24, 2018, now U.S. Pat. No. 10,459,380, issued on Oct. 29, 2019, which is based upon and claims the benefit of priority from Japanese Patent Application No. 2018-002878, filed on Jan. 11, 2018, the entire contents of each of which are incorporated herein by reference.

FIELD

Embodiments described herein relate generally to a fixing device and an image forming apparatus.

BACKGROUND

A fixing device of the related art includes a fixing belt, a pressure roller, a heating unit, and a reflecting unit.

The fixing belt is formed in a cylindrical shape. The roller presses against the fixing belt so as to form a fixing nip. The heating unit radiates heat. The heating unit is surrounded by the fixing belt. The reflecting unit is also surrounded by the fixing belt. The reflecting unit reflects heat generated from the heating unit.

Paper is conveyed to the fixing nip between the fixing belt and the roller. The paper is heated through the fixing belt due to heat, which is generated from the heating unit and is reflected from the reflecting unit as needed. Accordingly, a toner transferred to the paper is fixed to the paper.

However, the fixing device having such a configuration may be used for an image forming apparatus for high-speed printing which requires relatively high electric power of the heating unit. In this case, heat transfer efficiency from the heating unit to the belt may decrease as a result of the temperature of the reflecting member becoming too high.

DETAILED DESCRIPTION

Embodiments provide a fixing device capable of improving heat transfer efficiency from a heating unit to a belt, and an image forming apparatus comprising the fixing device.

In general, according to one embodiment, there is provided a fixing device including a belt having a cylindrical shape, a roller, a heater, and a reflector. The roller is positioned to be in contact with an outer peripheral surface of the belt so as to form a nip between the roller and the belt. The heater is disposed within an inner circumference the belt. The reflector is disposed within the inner circumference the belt and in contact with the belt and configured to reflect heat generated by the heater toward an inner surface of the belt.

Hereinafter, the fixing device and the image forming apparatus of the embodiment will be described with reference to drawings.

Figure 1:
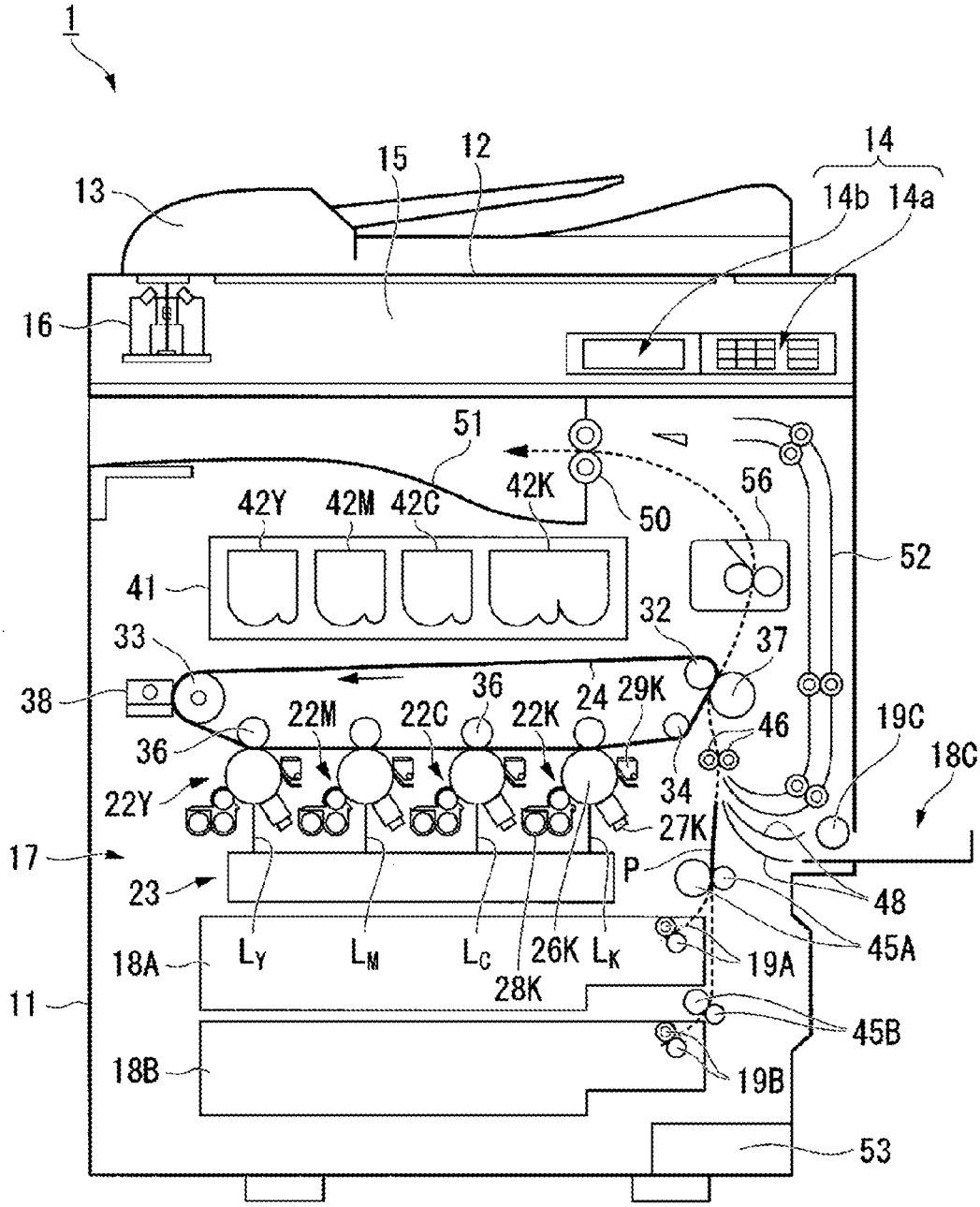
FIG. 1 is a sectional view illustrating a configuration example of an image forming apparatus of an embodiment.

An image forming apparatus of the embodiment is illustrated in FIG. 1 (as image forming apparatus 1) and may be, for example, a multi-function peripheral (MFP), printer, copy machine, and the like. Hereinafter, an example of a case in which the image forming apparatus is the MFP will be described.

A configuration of the image forming apparatus of the embodiment is not particularly limited. For example, the image forming apparatus 1 includes a main body 11. A document platen 12 including transparent glass is provided on an upper portion of the main body 11. An automatic document feeder (ADF) 13 is provided on the document platen 12. An operation unit 14 is provided on the upper portion of the main body 11. The operation unit 14 includes an operation panel 14*a* including various keys and a touch panel display 14*b*.

A scanner unit 15 is provided on a lower portion of the ADF 13. The scanner unit 15 reads a document conveyed by the ADF 13 or a document placed on the document platen 12. The scanner unit 15 generates image data of the document. For example, the scanner unit 15 includes an image sensor 16. For example, the image sensor 16 may be a contact type image sensor.

The image sensor 16 moves parallel to a surface of the document platen 12 when reading an image of a document placed on the document platen 12.

The main body 11 includes a printer unit 17 at the center in a height direction. The main body 11 includes paper feeding cassettes 18A and 18B on a lower portion thereof and a manual paper feeding unit 18C.

The paper feeding cassettes 18A and 18B are disposed inside the main body 11. The paper feeding cassettes 18A and 18B are disposed to be overlapped with each other in this order from an upper side to a lower side.

The manual paper feeding unit 18C protrudes from a side of the main body 11 down below a reverse conveyance path 52 to be described later.

The paper feeding cassettes 18A and 18B and the manual paper feeding unit 18C accommodate sheets of paper P having various sizes. The paper feeding cassettes 18A and 18B and the manual paper feeding unit 18C accommodate the sheets of paper P having different sizes so that the center axis of the sheets in the conveying direction are the same even though the sheets of different sizes are accommodated therein.

The paper feeding cassette 18A (18B) includes paper feeding mechanisms 19A (19B). Also, the paper feeding cassette 18A (18B) including the paper feeding mechanisms 19A (19B) means both the paper feeding cassette 18A including the paper feeding mechanisms 19A and the paper feeding cassette 18B including the paper feeding mechanism 19B. Meaning described above applies in the same way in the description hereinafter.

The paper feeding mechanisms 19A (19B) pick up the sheet P from the paper feeding cassette 18A (18B) one by one and sends the sheet to a conveyance path of the sheet P. For example, the paper feeding mechanisms 19A (19B) may include pickup rollers, separating rollers, and paper feeding rollers.

The manual paper feeding unit 18C includes a manual paper feeding mechanism 19C. The manual paper feeding mechanism 19C picks up the sheet P from the manual paper feeding unit 18C one by one and sends the sheet to the conveyance path.

The printer unit 17 forms an image on the sheet P based on image data read by the scanner unit 15 or image data generated by a personal computer or the like. The printer unit 17 is, for example, a tandem type color printer.

The printer unit 17 includes image generating units 22Y, 22M, 22C, and 22K for each color of yellow (Y), magenta (M), cyan (C), and black (K) corresponding to color separating components of a color image, an exposure unit 23, and an intermediate transfer belt 24. In the embodiment, the printer unit 17 includes the four image generating units 22Y, 22M, 22C, and 22K.

Also, a configuration of the printer unit 17 is not limited to the above description, and the printer unit may include two or three image generating units, or may include five or more image generating units.

The image generating units 22Y, 22M, 22C, and 22K are disposed below the intermediate transfer belt 24. The image generating units 22Y, 22M, 22C, and 22K are disposed in parallel along a downstream side from an upstream side in a moving direction of the intermediate transfer belt 24 below the intermediate transfer belt 24 (direction from left side toward right side in drawing).

In the exposure unit 23, light sources, a polygon mirror, an f-θ lens, a reflecting mirror, and the like (none of which are illustrated) are included. The exposure unit 23 irradiates a front surface of a photoconductor 26K and the like to be described later of each of the image generating units 22Y, 22M, 22C, and 22K with each of exposure light beams Ly, Lm, Lc, and Lk based on the image data.

The exposure unit 23 in one example generates a laser scanning beam as exposure light. The exposure unit 23 in another example includes a solid scanning element such as LED which generates exposure light.

A configuration of each of the image generating units 22Y, 22M, 22C, and 22K is the same as one another except toner colors which are different from each other. As a toner, either of a general color toner and a decolorable toner may be used. Decolorable toner is a toner which becomes transparent when the toner is heated at a certain temperature or more. The image forming apparatus 1 may be an image forming apparatus capable of using the decolorable toner, or may be an image forming apparatus not capable of using the decolorable toner.

Hereinafter, regarding a common configuration of each of the image generating units 22Y, 22M, 22C, and 22K, the image generating unit 22K is given as an example.

Figure 2:
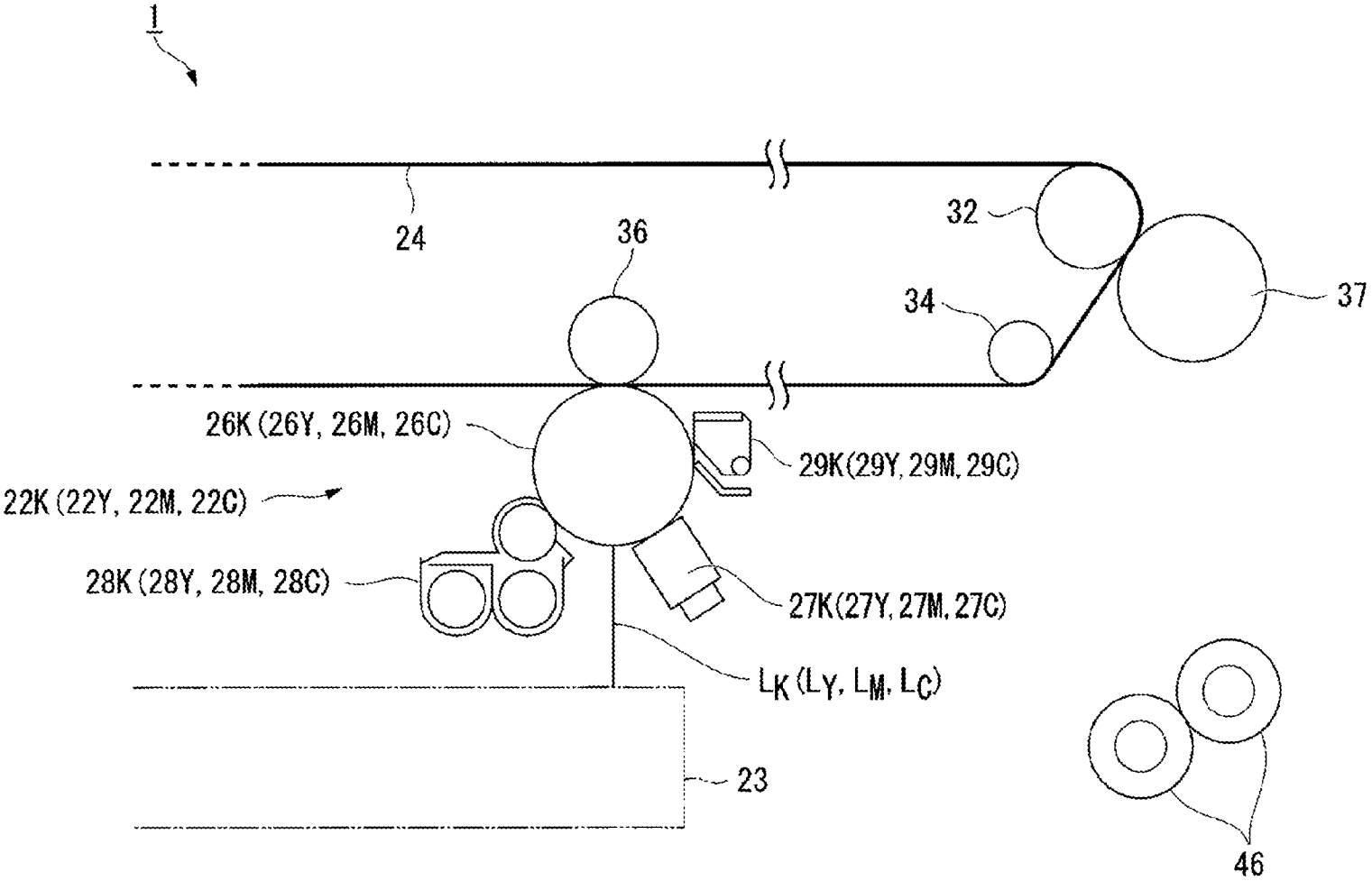
FIG. 2 is a sectional view in which a part of the image forming apparatus of the embodiment is enlarged.

As illustrated in FIG. 2, the image generating unit 22K includes the photoconductor 26K, a charger 27K, a developer 28K, and a cleaner 29K. Also, in FIG. 1, with respect to only the image generating unit 22K, reference numerals of the photoconductor 26K, the charger 27K, the developer 28K, and the cleaner 29K are illustrated.

As illustrated in FIG. 2, the photoconductor 26K is formed in a drum shape. The photoconductor 26K includes an electrostatic latent image formed by the exposure light beam Lk. The charger 27K charges the front surface of the photoconductor 26K. The developer 28K supplies toner to the front surface of the photoconductor 26K, and develops the electrostatic latent image. The cleaner 29K cleans the front surface of the photoconductor 26K.

As illustrated in FIG. 1, the intermediate transfer belt 24 is a belt with an endless shape. The intermediate transfer belt 24 is supported by a secondary transfer backup roller 32, a cleaning backup roller 33, and a tension roller 34. In this example, when the secondary transfer backup roller 32 is rotated and driven, the intermediate transfer belt 24 circulates and travels in a direction illustrated by an arrow in FIG. 1.

Primary transfer rollers 36, a secondary transfer roller 37, and a belt cleaning mechanism 38 are disposed around the intermediate transfer belt 24.

As illustrated in FIG. 2, the primary transfer roller 36 forms a primary transfer nip with the intermediate transfer belt 24 pinched between the photoconductor 26K and the like and the roller. In addition, a power supply which is not illustrated is connected to the primary transfer roller 36, and at least one of a predetermined direct current voltage (DC) and alternating current voltage (AC) is applied to the primary transfer roller 36.

The secondary transfer roller 37 forms a secondary transfer nip with the intermediate transfer belt 24 pinched between the secondary transfer backup roller 32 and the roller. In addition, in the same manner as the primary transfer roller 36, a power supply which is not illustrated is also connected to the secondary transfer roller 37. At least one of a predetermined direct current voltage and alternating current voltage is applied to the secondary transfer roller 37.

The belt cleaning mechanism 38 includes a cleaning brush and a cleaning blade which are provided to come into contact with the intermediate transfer belt 24. A waste toner transfer hose, which is not illustrated, extending from the belt cleaning mechanism 38 is connected to an entrance of a waste toner container which is not illustrated.

As illustrated in FIG. 1, a supplying unit 41 is disposed on an upper portion of each of the image generating units 22Y, 22M, 22C, and 22K.

The supplying unit 41 supplies toner to each of the image generating units 22Y, 22M, 22C, and 22K. The supplying unit 41 includes toner cartridges 42Y, 42M, 42C, and 42K. The toner cartridges 42Y, 42M, 42C, and 42K respectively accommodate yellow, magenta, cyan, and black toners.

Each of the toner cartridges 42Y, 42M, 42C, and 42K includes a sign portion, which is not illustrated and causes a main controller 53 to be described later to detect the types of toners accommodated in each of the toner cartridges 42Y, 42M, 42C, and 42K. The sign portion includes at least information relating to colors of the toners of the toner cartridges 42Y, 42M, 42C, and 42K and information for identifying whether or not a toner is a general toner or a decolorable toner.

A supply passage which is not illustrated is provided between each of the toner cartridges 42Y, 42M, 42C, and 42K and the developers 28Y, 28M, 28C, and 28K. A toner is supplied to the developers 28Y, 28M, 28C, and 28K from a corresponding one of the toner cartridges 42Y, 42M, 42C, and 42K through the supply passage.

Paper feeding rollers 45A and registration rollers 46 are provided on the conveyance path from the paper feeding cassette 18A to the secondary transfer roller 37. The paper feeding roller 45A carries the sheet P picked up from the inside of the paper feeding cassette 18A by the paper feeding mechanisms 19A.

The registration rollers 46 adjust a position of a tip end of the sheet P fed from the paper feeding rollers 45A at a position with which the registration rollers come into contact. The registration rollers 46 convey the sheet P to a secondary transfer nip.

Paper feeding rollers 45B are provided on the conveyance path from the paper feeding cassette 18B to the paper feeding rollers 45A. The paper feeding rollers 45B convey the sheet P picked up from the paper feeding cassette 18B by the paper feeding mechanism 19B toward the paper feeding rollers 45A.

The conveyance path is formed between the manual paper feeding mechanism 19C and the registration rollers 46 by a conveying guide 48. The manual paper feeding mechanism 19C carries the sheet P taken out from the manual paper feeding unit 18C toward the conveying guide 48. The sheet P moving along the conveying guide 48 reaches the registration rollers 46.

A fixing unit 56 of the embodiment is disposed on a downstream side (upper side in drawing) of the secondary transfer roller 37 in the conveying direction of the sheet P.

Conveying rollers 50 are disposed on a downstream side (upper left side in drawing) of the fixing unit 56 in the conveying direction of the sheet P. The conveying rollers 50 discharge the sheet P to a paper discharging unit 51.

The reverse conveyance path 52 is disposed on a downstream side (right side in drawing) of the fixing unit 56 in the conveying direction of the sheet P. The reverse conveyance path 52 causes the sheet P to be reversed and guides the sheet to the secondary transfer roller 37 side. The reverse conveyance path 52 is used for duplex printing.

The image forming apparatus 1 includes the main controller 53 which controls the entire of the image forming apparatus 1. The main controller 53 includes a central processing unit (CPU), memory, and the like.

Next, the fixing unit 56 will be described in detail. The fixing unit 56 is a so-called direct heating type fixing unit.

Figure 3:
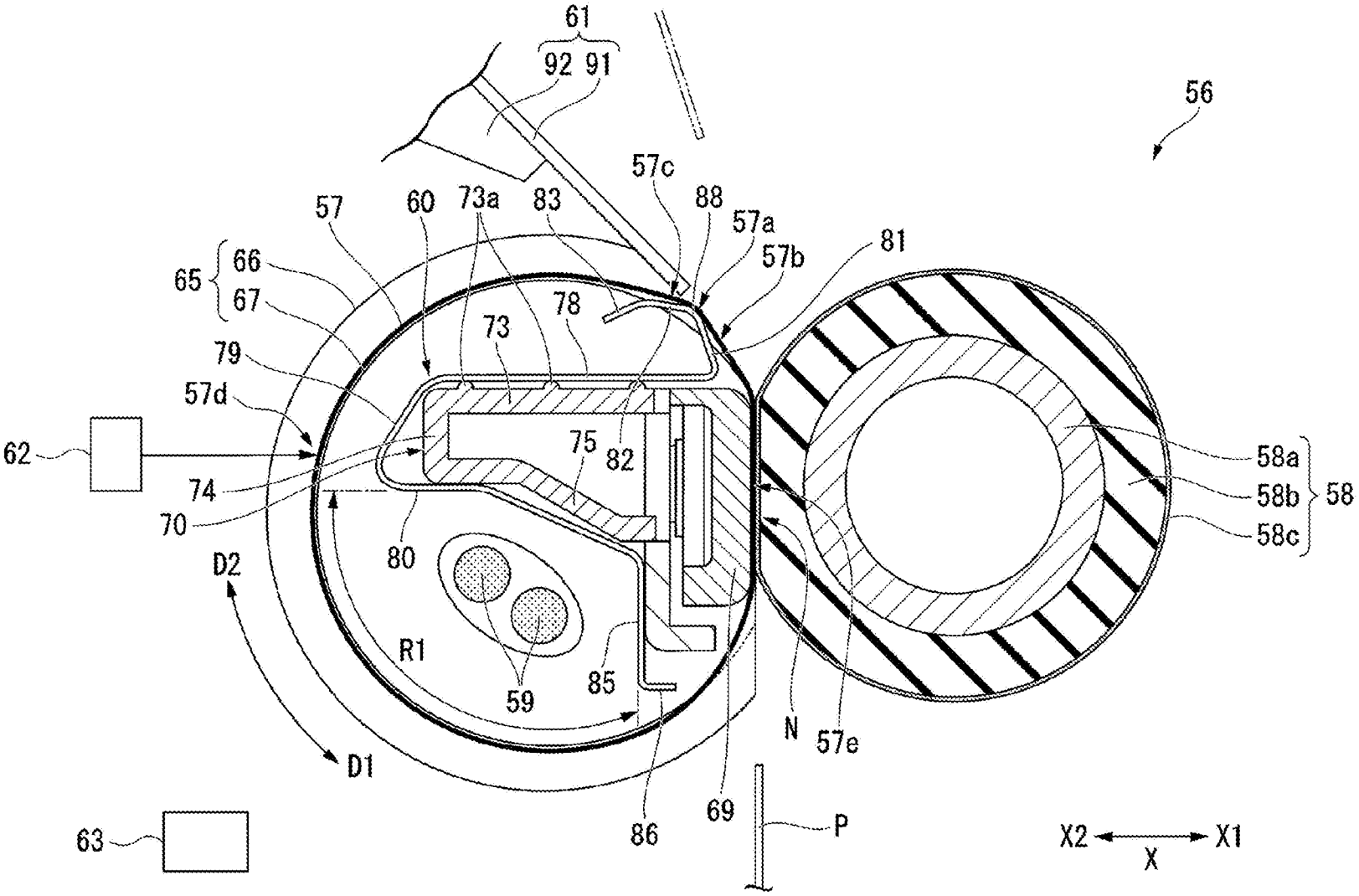
FIG. 3 is a sectional view illustrating a fixing unit in the image forming apparatus of the embodiment.

As illustrated in FIG. 3, the fixing unit 56 includes a fixing belt 57, a pressure roller 58, a halogen heater 59, a reflector 60, a peeling unit 61, a temperature sensor 62, and a fixing controller 63.

The fixing belt 57 is formed of a material having flexibility, in a thin cylindrical shape. The fixing belt 57 is a belt having an endless shape. The fixing belt 57 includes a cylindrical shaped base material and a release layer which is disposed on an outer peripheral surface of the base material, neither of which is illustrated. The base material is made of a metal material such as nickel or stainless steel, or a resin material such as polyimide (PI). For the release layer, tetrafluoroethylene-perfluoroalkyl vinyl ether copolymer (PFA), polytetrafluoroethylene (PTFE), or the like is used.

Also, an elastic layer, which is made of a rubber material such as silicone rubber, expandable silicone rubber, or fluororubber, may be interposed between the base material and the release layer.

A supporting member 65 is fit at both end portions of the fixing belt 57 in a shaft direction (hereinafter, simply referred to as shaft direction). The supporting member 65 includes a disk shaped large diameter portion 66 and a cylindrical shaped small diameter portion 67. The diameter of the large diameter portion 66 is greater than the diameter of the small diameter portion 67. The small diameter portion 67 is coaxially fixed to the large diameter portion 66. The small diameter portion 67 is inserted into an end portion of the fixing belt 57 in the shaft direction. The supporting member 65 maintains a shape of both end portions of the fixing belt 57 in the shaft direction. However, an intermediate portion of the fixing belt 57 in the shaft direction is easily deformed because the supporting member 65 is not fit thereto.

The fixing belt 57 is rotatable around a shaft of the fixing belt 57 in a state of being supported by the supporting member 65.

In the embodiment, the pressure roller 58 and the fixing belt 57 extend in parallel directions along a horizontal plane. Hereinafter, a direction from the fixing belt 57 toward the pressure roller 58 along the horizontal plane is referred to as a right side X1. A direction from the pressure roller 58 toward the fixing belt 57 along the horizontal plane is referred to as a left side X2.

The pressure roller 58 includes a core metal 58*a*, an elastic layer 58*b*, and a release layer 58*c*.

The core metal 58*a* is formed of a metal or the like in a cylindrical shape. Both end portions of the core metal 58*a* are supported by a supporting member (not illustrated) in the fixing unit 56 through a bearing (not illustrated). The core metal 58*a* is rotatable around the supporting member through the bearing.

The elastic layer 58*b* is made of expandable silicone rubber, silicon rubber, fluororubber, or the like, and is provided on the outer peripheral surface of the core metal 58*a*. The release layer 58*c* is made of PFA, PTFE, or the like, and is provided on the outer peripheral surface of the elastic layer 58*b*.

The pressure roller 58 is pressurized by a pressurizing unit, which is not illustrated, toward the left side X2 (fixing belt 57 side) so as to be in contact with an outer peripheral surface of the fixing belt 57. The pressure roller 58 presses against a nip forming member 69 through the fixing belt 57. The nip forming member 69 is disposed inside a circumference of the fixing belt 57. The nip forming member 69 will be described later.

In a part of the pressure roller 58 that presses against the fixing belt 57, the elastic layer 58*b* of the pressure roller 58 is compressed, and thus a fixing nip N having a predetermined width is formed in the conveying direction of the sheet P. In the fixing nip N, the pressure roller 58 presses the sheet P against the fixing belt 57. Hereinafter, the part of the fixing belt 57 for forming the fixing nip N is referred to as a nip forming portion 57*e*.

The pressure roller 58 is rotated and driven by a driving source such as a motor, which is not illustrated, provided in the main body 11. When the pressure roller 58 is rotated and driven, a driving force thereof is transmitted to the fixing belt 57 through the fixing nip N, and the fixing belt 57 is driven and rotated. The fixing belt 57 is rotated in a first circumferential direction D1 of the fixing belt 57 when conveying the sheet P.

Also, a heating source such as a halogen heater may be provided inside the core metal 58*a* of the pressure roller 58. In addition, if the pressure roller 58 does not include the elastic layer 58*b*, heat capacity of the pressure roller decreases such that fixing property is improved.

Meanwhile, when unfixed toner is compressed to be fixed, minute undulations on the front surface of the fixing belt 57 are transferred to the image, and it is possible for gloss unevenness to be generated on a solid portion of the image. In order to prevent transferring of the minute undulations and generating of the gloss unevenness, it is preferable that the elastic layer 58*b* having a thickness of 150 μm (micrometer) or more is provided on the pressure roller 58. When the elastic layer 58*b* having the thickness of 150 μm or more is provided, the minute undulations can be absorbed due to elastic deformation of the elastic layer 58*b*, and thereby making it possible to avoid generation of the gloss unevenness.

The elastic layer 58*b* may be made of solid rubber, but if there is no heating source inside the pressure roller 58, the elastic layer 58*b* may be made of sponge rubber. It is desirable that the elastic layer 58*b* is made of sponge rubber, because a heat insulating property of the elastic layer 58*b* is high so that heat of the fixing belt 57 is not easily transferred to the pressure roller 58.

The pressure roller 58 may be configured to be hollow, or may be configured to be solid.

The fixing unit 56 includes a plurality of the halogen heaters 59 (two in this embodiment). Also, the number of the halogen heaters 59 included in the fixing unit 56 may be one or three or more.

The halogen heaters 59 are disposed inside the fixing belt 57 along a shaft direction of the fixing belt 57. Each end portion of the halogen heaters 59 is fixed to the small diameter portion 67 or the like of the supporting member 65. The halogen heaters 59 are disposed to face the inner circumference of the fixing belt 57. The halogen heaters 59 generate heat for heating the fixing belt 57 by controlling an output of a power source (not illustrated) provided in the main body 11.

It is not illustrated, but the nip forming member 69 includes a base pad and a sliding sheet.

The base pad is formed of a heat resistance member having a heat resistant temperature 200° C. or more. Accordingly, in a toner fixing temperature range, deformation of the base pad due to heat is prevented. Further, a stable state of the fixing nip N is secured, and stabilization of output image quality is achieved.

The base pad has a function of determining a shape of the fixing nip N, which is formed by the pressure roller 58, facing the base pad pinching the sliding sheet between the roller and the pad. Therefore, a surface of the fixing nip N facing the base pad is substantially flat.

In order to maintain such a shape of the base pad, hard material is used for the base pad. Specifically, crystalline thermoplastic plastics being used for liquid crystal polymer (LCP) or the like, for example, molded articles such as aramid fibers are used. In addition, instead of resin, materials such as metals or ceramics which are capable of maintaining the shape thereof may be used.

Also, to the base pad, general heat resistant resin may be used, such as polyether sulfone (PES), polyphenylene sulfide (PPS), liquid crystal polymer (LCP), polyether nitrile (PEN), polyamide imide (PAI), and polyether ether ketone (PEEK).

The sliding sheet is a low friction sheet and covers the front surface of the base pad. The sliding sheet is made of, for example, PTFE. When the fixing belt 57 is rotated, the fixing belt 57 is slid on a front surface of the sliding sheet. Therefore, a driving torque being generated in the fixing belt 57 when the fixing belt 57 slides along the sliding sheet is reduced, and thereby making it possible to reduce load being generated due to a frictional force to the fixing belt 57.

The nip forming member 69 is disposed to extend along the shaft direction. The nip forming member 69 is supported by the stay 70.

The stay 70 is disposed at the center of an inner circumference area of the fixing belt 57. The stay 70 includes an upper supporting plate 73, a connecting member 74, and a lower supporting plate 75. The upper supporting plate 73 is disposed so that a thickness direction thereof is along a vertical direction (i.e., the upper supporting plate 73 is along a horizontal plane). A plurality of protruding portions 73*a* which protrude from the upper supporting plate 73 toward the upper side are provided on an upper surface of the upper supporting plate 73. The plurality of protruding portions 73*a* are disposed with intervals therebetween along a horizontal direction X on an upper surface of the upper supporting plate 73.

The connecting member 74 protrudes downward from a left end portion of the upper supporting plate 73. The lower supporting plate 75 is partially inclined downward along a direction toward the right side X1 from a lower end portion of the connecting member 74. In the stay 70 having such a configuration, when viewed along the shaft direction, the stay 70 is formed in a U-letter shape with its right side opened.

When the nip forming member 69 is supported by the stay 70, bending of the nip forming member 69 due to pressure from the pressure roller 58 is prevented, and uniform width of the fixing nip N along the shaft direction can be obtained. Also, the stay 70 is desirably formed of a metal material having a high mechanical rigidity such as stainless steel (SUS) or iron in order to prevent the nip forming member 69 from being bent. Alternatively, the stay 70 may be formed of resin.

The reflector 60 includes a top board 78, a connecting board 79, a bottom board 80, a first overhanging board 81, a second overhanging board 82, and an evacuation board 83. The reflector 60 is formed by bending a board material. The board material for forming the reflector 60 is preferably, for example, a metal material having a relatively high melting point such as aluminum or stainless steel. The reflector 60 is disposed within the inner circumference of the fixing belt 57, and reflects heat generated from the plurality of halogen heaters 59 toward the fixing belt 57.

The top board 78 is disposed on the upper side of the upper supporting plate 73 of the stay 70 so as to face the upper supporting plate 73. The lower surface of the top board 78 is in contact with the plurality of protruding portions 73*a* of the upper supporting plate 73. A gap is formed between the top board 78 and the upper supporting plate 73. Because of the gap, heat of the reflector 60 is not easily transmitted to the upper supporting plate 73 of the stay 70.

The connecting board 79 is gradually inclined toward the left side X2 from the left end portion of the top board 78 to the bottom. The connecting board 79 is disposed on the left side X2 of the connecting member 74.

The bottom board 80 is partially inclined downward from the lower end portion of the connecting board 79 toward the right side X1. The bottom board 80 is in contact with the lower supporting plate 75 from the bottom of the lower supporting plate 75. A first extension board 85 extending downward is provided on a right end portion of the bottom board 80. A second extension board 86 protruding toward the right side X1 is provided on a lower end portion of the first extension board 85. The second extension board 86 is an end portion of the reflector 60 in a second circumferential direction D2 of the fixing belt 57 from where the fixing nip N is pinched. The second direction D2 is a direction opposite to the first direction D1 in the circumferential direction.

The halogen heaters 59 described above are disposed on the left side X2 of the first extension board 85 down below the bottom board 80. The bottom board 80 and the first extension board 85 of the reflector 60 reflect heat generated from the plurality of halogen heaters 59 toward a range R1 of the fixing belt 57. That is, the range R1 is a range where heat is reflected by the bottom board 80 and the first extension board 85 of the reflector 60 in the fixing belt 57. The bottom board 80 and the first extension board 85 corresponding to the range R1 of the fixing belt 57 may be referred to as a reflector board.

When heat is reflected by the reflector 60, amount of heat being applied to the fixing belt 57 from the halogen heaters 59 can be increased, and the fixing belt 57 can be efficiently heated. In addition, transmission of radiation heat from the halogen heaters 59 to the stay 70 or the like is suppressed, and thus energy saving is achieved.

Also, reflectance of a reflective surface of the reflector 60 or the stay 70 is desirably 90% or more.

It is not possible to freely select a shape or a material of the stay 70 in order to ensure strength thereof. Therefore, when the reflector 60 is separately provided from the stay 70 as in the embodiment, a degree of freedom in selecting the shape or the material of the stay 70 is increased. Further, it is possible to specialize each function of the reflector 60 and the stay 70.

In addition, when the reflector 60 is provided between the halogen heaters 59 and the stay 70, a distance between the halogen heaters 59 and the reflector 60 is shortened, and thus the fixing belt 57 can be efficiently heated due to heat reflected by the reflector 60.

The first overhanging board 81 is gradually inclined toward the left side X2 from a right end portion of the top board 78 toward the upper side. The second overhanging board 82 is gradually inclined upward from the upper end portion of the first overhanging board 81 toward the left side X2. The second overhanging board 82 is inclined toward the left side X2 of the first overhanging board 81. The evacuation board 83 is inclined downward from a left end portion of the second overhanging board 82 toward the left side X2. The evacuation board 83 is an end portion of the reflector 60 in the first circumferential direction D1 from where the fixing nip N is pinched. The second overhanging board 82 is a part adjacent and connected to the evacuation board 83 in the reflector 60 in the second circumferential direction D2.

The evacuation board 83 is disposed within the inner circumference of the fixing belt 57 in a radial direction relative to the second overhanging board 82.

A connection part 88 between the first overhanging board 81 and the second overhanging board 82 protrudes to the outside in the radial direction more than other parts of the overhanging boards 81 and 82. The connection part 88 comes into contact with the inner circumference of the fixing belt 57. Hereinafter, the part of the fixing belt with which the connection part 88 comes into contact is referred to as an overhanging portion 57*a*. The overhanging portion 57*a* is disposed on a downstream side of the fixing nip N in the fixing belt 57 in the conveying direction of the sheet P.

The connection part 88 causes the overhanging portion 57*a* to protrude outwardly in the radial direction more than parts 57*b* and 57*c* adjacent to the overhanging portion 57*a* in the fixing belt 57, and to increase a curvature (to decrease curvature radius) thereof.

The evacuation board 83 is separated in the radial direction from the fixing belt 57 (i.e., is not in contact with the fixing belt 57). Also, the top board 78, the connecting board 79, the bottom board 80, the first extension board 85, and the second extension board 86 of the reflector 60 are also separated from the fixing belt 57 in the radial direction.

The first overhanging board 81, the second overhanging board 82, and the evacuation board 83 may be disposed along the entire length of the fixing belt 57 in the shaft direction or just the center portions along the length of the fixing belt 57 in the shaft direction. The first overhanging board 81, the second overhanging board 82, and the evacuation board 83 may be collectively referred to as a thermally-conductive member.

The reflector 60 having such a configuration is fixed to the stay 70 by a screw or the like which is not illustrated.

A shape of the peeling unit 61 is not particularly limited. In the embodiment, the peeling unit 61 includes a main body 91 and a supporting member 92. The main body 91 is formed in a board shape using resin, a metal, or the like. A distal end portion of the main body 91 is disposed on a downstream side of the overhanging portion 57*a* in a conveying direction so as to be adjacent to the overhanging portion 57*a*. The distal end portion of the main body 91 is preferably disposed at the same position as that of the overhanging portion 57*a* in the radial direction or inwardly of the overhanging portion 57*a* in the radial direction. The main body 91 preferably extends in a tangential direction of the fixing belt 57 at the part of the fixing belt 57 that is adjacent to the distal end portion of the main body 91.

The supporting member 92 supports a base end portion of the main body 91.

As the temperature sensor 62, a non-contact type sensor is used in the embodiment. Also, a contact type sensor may be used as a temperature sensor.

The temperature sensor 62 measures a temperature of a measuring target portion 57*d* in the fixing belt 57. The measuring target portion 57*d* is the part of the fixing belt 57 on the first circumferential direction D1 side of the nip forming portion 57*e*, and the second circumferential direction D2 side of the range R1. The nip forming portion 57*e*, the overhanging portion 57*a*, and the measuring target portion 57*d* are arranged in the first circumferential direction D1 in that order.

The temperature sensor 62 periodically transmits a temperature measurement result to the fixing controller 63.

The fixing controller 63 includes a central processing unit (CPU), a memory, and the like. The fixing controller 63 controls the fixing unit 56.

Next, operations of the image forming apparatus 1 having such a configuration will be described based on operations of the fixing unit 56.

For example, an operator reads image data by reading a document using the scanner unit 15. The main controller 53 transmits an instruction for starting a warm-up operation to the fixing controller 63 of the fixing unit 56.

The fixing controller 63 drives the halogen heaters 59. Heat generated from the halogen heaters 59 directly heats the fixing belt 57. Meanwhile, the heat which is generated from the halogen heaters 59 and reflected by the reflector 60 indirectly heats a part of the fixing belt 57 in the range R1. That is, a temperature of the part of the fixing belt 57 in the range R1 is increased more than that of the other parts of the fixing belt 57.

The temperature of the reflector 60 is increased due to the heat generated from the halogen heaters 59. Heat of the reflector 60 is transmitted to the overhanging portion 57*a* of the fixing belt 57 in contact with the connection part 88 from the connection part 88 of the reflector 60.

The fixing controller 63 adjusts outputting of the halogen heaters 59 based on the measured result of the temperature sensor 62, and adjusts the temperature of the measuring target portion 57*d* of the fixing belt 57 to become a predetermined temperature.

The main controller 53 rotates and drives the pressure roller 58 by a driving source. With a driving force thereof, the fixing belt 57 is rotated in the first circumferential direction D1.

The main controller 53 transfers each toner image generated by the image generating units 22Y, 22M, 22C, and 22K of the printer unit 17 to the sheet P inside the paper feeding cassette 18A based on the image data read by the scanner unit 15. The sheet P to which each toner image is transferred is conveyed into the fixing unit 56 from the bottom of the fixing unit 56 as illustrated in FIG. 3. When the sheet passes through the fixing nip N of the fixing unit 56, the sheet P and each toner image are heated, and each toner image is fixed onto the sheet P. When the sheet P passes through the overhanging portion 57*a* of the fixing belt 57, the distal end portion of the main body 91 of the peeling unit 61 is inserted between the fixing belt 57 and the sheet P. The peeling unit 61 separates the sheet P from the fixing belt 57. The separated sheet P is moved to a position illustrated by two-dot chain line in FIG. 3.

The main controller 53 discharges the sheet P passed through the fixing unit 56 to the paper discharging unit 51 by the conveying rollers 50.

As described above, in the fixing unit 56 of the embodiment, the reflector 60 is in contact with the fixing belt 57. Heat generated by the halogen heaters 59 and reflected from the reflector 60 is transmitted to the fixing belt 57, and thus heat transfer efficiency from the halogen heaters 59 to the fixing belt 57 can be improved.

Even when reflectance of the reflector 60 is 90% or more, as the halogen heaters 59 become a higher output power, the temperature of the reflector 60 is increased so as to exceed, for example, 300° C. In this case, efficiency of the halogen heaters 59 for heating the fixing belt 57 decreases. When the connection part 88 in contact with the fixing belt 57 is formed in the reflector 60, heat energy accumulated in the reflector 60 is supplied to the fixing belt 57, and the fixing unit 56 can be correspond to the image forming apparatus 1 performing high speed printing.

The fixing unit 56 includes the peeling unit 61 in which a distal end portion adjacent to the overhanging portion 57*a* is disposed on a downstream side of the overhanging portion 57*a* in the conveying direction. Accordingly, the peeling unit 61 is inserted between the fixing belt 57 and the sheet P, and it is possible to easily peel off the sheet P from the fixing belt 57.

The measuring target portion 57*d* in which the temperature is measured by the temperature sensor 62 in the fixing belt 57 is positioned on the first circumferential direction D1 side of the overhanging portion 57*a* in the fixing belt 57 to which heat is transmitted by the reflector 60, and on the second circumferential direction D2 side of a part of the fixing belt 57 in the range R1. Accordingly, based on a temperature of the measuring target portion 57*d* of the fixing belt 57 before being indirectly heated by the reflector 60 after being heated by the connection part 88 of the reflector 60, it is possible to stably control the temperature of the fixing belt 57.

In the reflector 60, the evacuation board 83 is disposed in the inside of the second overhanging board 82 in the radial direction. Accordingly, the evacuation board 83 cannot be easily hooked by the fixing belt 57.

In addition, according to the image forming apparatus 1 of the embodiment, it is possible to configure the image forming apparatus 1 using the fixing unit 56 in which heat transfer efficiency from the halogen heaters 59 to the fixing belt 57 is improved.

Also, the heating unit is the halogen heater 59. However, the heating unit is not limited thereto, and an induction heating (IH) heater or the like may be used.

In alterative embodiments, the fixing unit 56 may not include the peeling unit 61, the temperature sensor 62, the evacuation board 83 of the reflector 60. If the fixing unit 56 does not include the temperature sensor 62, a position where the reflector 60 is in contact with the fixing belt 57 is not particularly limited.

According to at least one of the embodiments described above, the reflector 60 is included, and thus heat transfer efficiency from the halogen heaters 59 to the fixing belt 57 can be improved.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A fixing device comprising:

a belt rotatable in a rotational direction;

a roller positioned to be in contact with an outer surface of the belt so as to form a nip between the roller and the belt;

a heater configured to heat an inner surface of the belt;

a reflector board configured to reflect heat generated by the heater toward the inner surface of the belt;

a stay in contact with the reflector board; and a thermally-conductive member that is thermally connected between the belt and at least one of the reflector board and the stay, the thermally-conductive member including a first portion that is in contact with the belt at a first region downstream with respect to the nip in the rotational direction.

2. The fixing device according to claim 1, wherein the stay is disposed between the heater and the first portion of the thermally-conductive member.

3. The fixing device according to claim 1, wherein the thermally-conductive member comprises a board that is integrally formed with the reflector board.

4. The fixing device according to claim 1, further comprising:

a nip forming member against which the roller presses the belt.

5. The fixing device according to claim 1, wherein the reflector board covers the stay.

6. The fixing device according to claim 1, wherein the reflector board is not provided between the belt and the roller at the nip.

7. The fixing device according to claim 1, wherein the reflector board comprises a board material that is bent a plurality of times.

8. The fixing device according to claim 1, wherein the reflector board is bent to form a concave reflecting surface that faces the heater.

9. The fixing device according to claim 1, wherein the reflector board reflects the heat generated by the heater toward the heater.

10. The fixing device according to claim 1, wherein the thermally-conductive member is in contact with no other regions of the belt than the first region.

11. The fixing device according to claim 1, wherein the heater is not in contact with any of the belt, the reflector board, and the thermally-conductive member.

12. The fixing device according to claim 11, wherein the heater comprises a halogen lamp.

13. The fixing device according to claim 1, wherein the thermally-conductive member outwardly protrudes toward the belt.

14. The fixing device according to claim 13, wherein the thermally-conductive member outwardly protrudes toward the belt at the first region.

15. The fixing device according to claim 14, wherein the stay is in contact with the thermally-conductive member.

16. The fixing device according to claim 1, further comprising:

a sheet peeler configured to peel a sheet that has been fed out of the nip.

17. The fixing device according to claim 16, wherein the sheet peeler is pressed against the belt by the roller at a position adjacent to the first region of the belt.

18. The fixing device according to claim 17, further comprising:

a temperature sensor positioned to measure a temperature of a measuring target portion of the belt.

19. The fixing device according to claim 18, wherein the measuring target portion is downstream with respect to the first region of the belt in the rotational direction.

20. The fixing device according to claim 1, wherein a plurality of gaps is formed between the reflector board and the stay so as to suppress heat conduction from the reflector board to the stay.

* * * * *